US007594279B2

(12) United States Patent
Roy

(10) Patent No.: US 7,594,279 B2
(45) Date of Patent: Sep. 29, 2009

(54) INCONTINENCE DRESS

(76) Inventor: Laura Roy, 124 Laird St., Greensburg, PA (US) 15601

( * ) Notice: Subject to any disclaimer, the term of this patent is extended or adjusted under 35 U.S.C. 154(b) by 121 days.

(21) Appl. No.: 11/532,341

(22) Filed: Sep. 15, 2006

(65) Prior Publication Data

US 2007/0083976 A1 Apr. 19, 2007

Related U.S. Application Data

(60) Provisional application No. 60/717,974, filed on Sep. 16, 2005.

(51) Int. Cl.
*A41D 10/00* (2006.01)

(52) U.S. Cl. ..... 2/114

(58) Field of Classification Search ..... 2/77, 2/114, 83, 247, 75, 115, 267
See application file for complete search history.

(56) References Cited

U.S. PATENT DOCUMENTS

| | | | | | |
|---|---|---|---|---|---|
| 818,351 | A | * | 3/1906 | Mulally | 2/114 |
| 1,080,451 | A | * | 12/1913 | Hutchinson | 2/114 |
| 1,489,046 | A | * | 4/1924 | Thompson | 2/114 |
| 2,546,057 | A | * | 3/1951 | Bodin et al. | 2/270 |
| 2,556,931 | A | * | 6/1951 | Miller | 2/114 |
| 3,369,256 | A | * | 2/1968 | Kern | 2/114 |
| 3,916,447 | A | * | 11/1975 | Thompson | 2/46 |
| 3,973,276 | A | * | 8/1976 | Moses | 2/215 |
| 4,128,902 | A | * | 12/1978 | Siebert | 2/464 |
| 4,570,268 | A | * | 2/1986 | Freeman | 2/114 |
| 4,601,067 | A | * | 7/1986 | Buonassissi | 2/102 |
| 4,663,782 | A | * | 5/1987 | Knox et al. | 2/104 |
| 4,686,715 | A | * | 8/1987 | Price | 2/114 |
| 4,698,848 | A | * | 10/1987 | Buckley | 2/114 |
| 4,718,124 | A | * | 1/1988 | Sawicki et al. | 2/114 |
| 4,736,467 | A | * | 4/1988 | Schwarze et al. | 2/114 |
| 4,737,994 | A | * | 4/1988 | Galton | 2/465 |
| 4,864,657 | A | * | 9/1989 | Lake | 2/114 |
| 4,870,706 | A | * | 10/1989 | Ketcham et al. | 2/461 |
| 4,894,867 | A | * | 1/1990 | Ceravolo et al. | 2/238 |
| 4,969,216 | A | * | 11/1990 | Guelli | 2/400 |
| 5,027,438 | A | * | 7/1991 | Schwarze et al. | 2/114 |
| 5,048,122 | A | * | 9/1991 | Prieur | 2/69 |
| 5,048,512 | A | * | 9/1991 | Turner et al. | 128/876 |
| 5,093,932 | A | * | 3/1992 | Doyle | 2/114 |
| 5,133,086 | A | * | 7/1992 | Truitt et al. | 2/114 |
| 5,142,702 | A | * | 9/1992 | Piloian | 2/102 |
| 5,142,704 | A | * | 9/1992 | Viemeister et al. | 2/202 |
| 5,157,789 | A | * | 10/1992 | Klass | 2/114 |
| 5,222,258 | A | * | 6/1993 | Mucci et al. | 2/114 |
| 5,395,280 | A | * | 3/1995 | Greenberg | 450/54 |
| 5,520,980 | A | * | 5/1996 | Morgan et al. | 442/312 |
| 5,594,955 | A | * | 1/1997 | Sommers | 2/114 |

(Continued)

*Primary Examiner*—Alissa L Hoey
(74) *Attorney, Agent, or Firm*—Eckert Seamans Cherin & Mellott, LLC; Carol A. Marmo, Esq.

(57) ABSTRACT

An incontinence dress that comprises: a first panel, a second panel, a third panel, and a fourth panel. The first panel is connected to the third panel, which is connected to the fourth panel, and the fourth panel is connected to the second panel. The incontinence dress also has means for detachably connecting the first panel to the second panel. Each of the first, second, third, and fourth panels is made from a three ply material that is water absorbent.

15 Claims, 6 Drawing Sheets

U.S. PATENT DOCUMENTS 5,603,123 A * 2/1997 Chupa ..... 2/275
5,611,086 A * 3/1997 Eggen ..... 2/104
5,636,377 A * 6/1997 Wiener ..... 2/465
5,652,962 A * 8/1997 Patnode ..... 2/114
5,722,094 A * 3/1998 Ruefer ..... 2/69.5
5,758,363 A * 6/1998 Winfree ..... 2/122
5,813,052 A * 9/1998 Taylor ..... 2/114
5,842,232 A * 12/1998 Parrish ..... 2/400
5,878,437 A * 3/1999 Pater ..... 2/69
5,918,310 A * 7/1999 Farahany ..... 2/23
5,926,845 A * 7/1999 Troyer ..... 2/93
5,991,923 A * 11/1999 Maria ..... 2/83
6,240,563 B1 * 6/2001 Niedermeyer ..... 2/114
6,312,051 B1 * 11/2001 Adams ..... 297/228.11
6,347,413 B1 * 2/2002 Sciscente et al. ..... 2/465
6,408,446 B1 * 6/2002 Carrington ..... 2/465
6,477,710 B1 * 11/2002 Ojoyeyi ..... 2/69
6,574,800 B1 * 6/2003 Leger et al. ..... 2/114
6,647,552 B1 * 11/2003 Hogan ..... 2/114
6,668,382 B1 * 12/2003 Wright ..... 2/75
6,694,521 B1 * 2/2004 Hopkins ..... 2/83
7,010,812 B1 * 3/2006 Cho et al. ..... 2/114
7,073,204 B1 * 7/2006 Boyles ..... 2/114
7,181,773 B1 * 2/2007 Piraka ..... 2/114
7,293,295 B2 * 11/2007 King ..... 2/114
7,305,716 B1 * 12/2007 Richards ..... 2/114
7,395,556 B2 * 7/2008 Eraca ..... 2/104
7,396,272 B1 * 7/2008 Newlen ..... 450/54
7,418,741 B2 * 9/2008 Rogers ..... 2/114
2001/0044948 A1 * 11/2001 Tolson ..... 2/114
2002/0026664 A1 * 3/2002 Grounds et al. ..... 2/465
2002/0108163 A1 * 8/2002 Steinman ..... 2/69
2003/0051288 A1 * 3/2003 Dugan ..... 2/228
2003/0104735 A1 * 6/2003 Rock et al. ..... 442/79
2004/0010837 A1 * 1/2004 Graves ..... 2/114
2004/0226073 A1 * 11/2004 McCullar et al. ..... 2/114
2005/0059945 A1 * 3/2005 Schulson ..... 604/385.24
2005/0102731 A1 * 5/2005 Beuk ..... 2/114
2006/0037124 A1 * 2/2006 Cho et al. ..... 2/114
2006/0085890 A1 * 4/2006 Beuk ..... 2/114
2006/0096003 A1 * 5/2006 Plaatje et al. ..... 2/114
2006/0143777 A1 * 7/2006 Dennis et al. ..... 2/114
2006/0253953 A1 * 11/2006 Williams ..... 2/69
2007/0157362 A1 * 7/2007 Rogers ..... 2/114
2007/0266473 A1 * 11/2007 Issel ..... 2/84
2008/0168592 A1 * 7/2008 Silver ..... 2/114

* cited by examiner

INCONTINENCE DRESS

CROSS REFERENCE TO RELATED APPLICATIONS

This invention claims priority under 119(e) from U.S. Provisional Application No. 60/717,974, which was filed on Sep. 16, 2005 and is incorporated by reference herein.

BACKGROUND OF THE INVENTION

1. Field of the Invention

This invention relates generally to dresses. More particularly, this invention relates to an incontinence dress.

2. Description of the Related Art

Incontinence, such as urinary incontinence, refers to the lack of voluntary control over excretory functions. The disorder is typically observed in adults. However, incontinence can be observed in children as well. Because individuals who have the disorder are not able to control their excretory functions, their clothing is often soiled with urine. In order to prevent their clothing from being soiled, many of these individuals wear diapers which are designed to absorb the urine.

Many older adults, however, are unable to wear the diapers due to physical complications that are related with their advanced age. For example, older adults often do not have the mobility, flexibility, strength or coordination to properly place the diapers in the correct position. Moreover, some older adults may not even be able to wear a diaper if he/she has a skin disorder that might be irritated by the diaper. Accordingly, there is a need for an incontinence garment which can be used by individuals with limited physical capabilities.

SUMMARY OF THE INVENTION

This need, as well as others, is met by various embodiments of the invention which provide an incontinence dress that is water absorbent.

In accordance with one embodiment of the invention, a first panel; a second panel; a third panel, a fourth panel; the first panel being connected to the third panel, the third panel being connected to the fourth panel, the fourth panel being connected to the second panel; means for detachably connecting the first panel to the second panel; and wherein each of the first, second, third, and fourth panels is made from a three ply material that is water absorbent.

In accordance with another embodiment of the invention, a first panel; a second panel; a third panel; the second panel being connected to the third panel; means for detachably connecting the first panel to the second panel; means for detachably connecting the first panel to the third panel; a pocket disposed on an interior surface of the third panel; means for detachably connecting the pocket to the interior surface; a water absorbent pad contained within the pocket; and wherein each of the first, second, and third panels is made from a three ply material that is water absorbent.

In accordance with yet another embodiment of the invention, an incontinence dress comprising: a first panel; a second panel; a third panel; each of said first and second panels being connected to said third panel; means for detachably connecting said first panel to said second panel; and wherein each of said first, second, and third panels is made from a three ply material that is water absorbent.

One aspect to this invention is provided an incontinence dress that is capable of absorbing urine.

Another aspect to this invention is to provide an incontinence dress that limits the amount of skin irritation that is caused by the dress when the dress comes into contact an individual's skin.

Yet another aspect to this invention is to provide an incontinence dress that can easily be removed or "slipped on" on an individual that has limited physical capabilities.

BRIEF DESCRIPTION OF THE DRAWINGS

A full understanding of the disclosed and claimed concept can be gained from the following Description when read in conjunction with the accompanying drawings in which:

DESCRIPTION OF THE PREFERRED EMBODIMENTS

Figure 1:
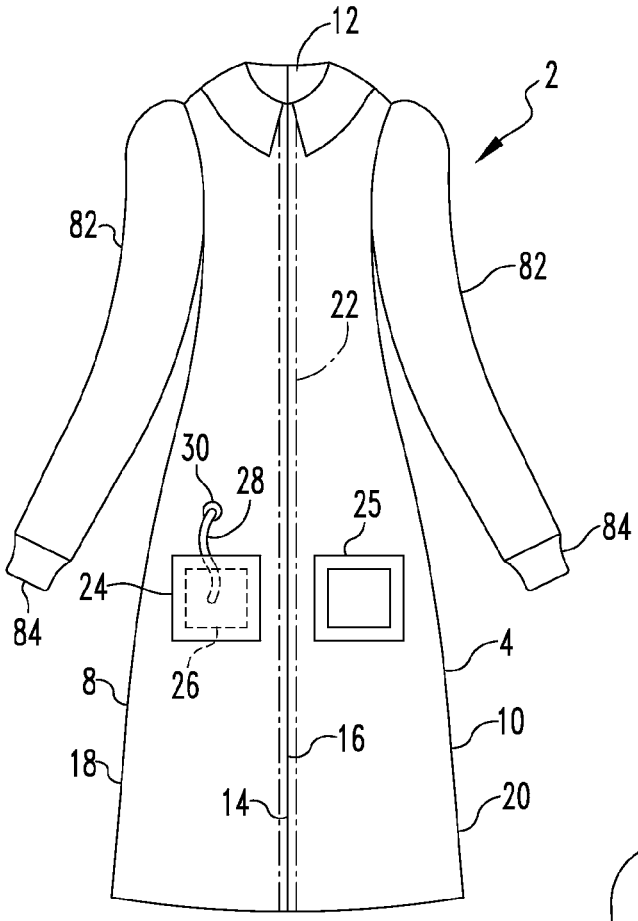
FIG. 1 is a front elevational view of the incontinence dress in accordance with an embodiment of the invention.

Directional phrases used herein, such as, for example, upper, lower, left, right, vertical, horizontal, top, bottom, above, beneath, clockwise, counterclockwise and derivatives thereof, relate to the orientation of the elements shown in the drawings and are not limiting upon the claims unless expressly recited therein.

As employed herein, the term "mechanical fastener" or variations thereof shall refer broadly to any suitable fastening, connecting or tightening mechanism including, but not limited to, snaps and clips.

As employed herein, the term "number" means one or an integer greater than one (i.e., a plurality).

As stated above, many individuals that have incontinence wear diapers in order to prevent their clothing from being soiled with bodily excretions, such as urine. Some of these individuals, however, are unable to wear these diapers for a variety of reasons. Accordingly, this invention provides an incontinence dress that is capable of absorbing urine thereby keeping the individual wearing the incontinence dress substantially dry.

Figure 2:
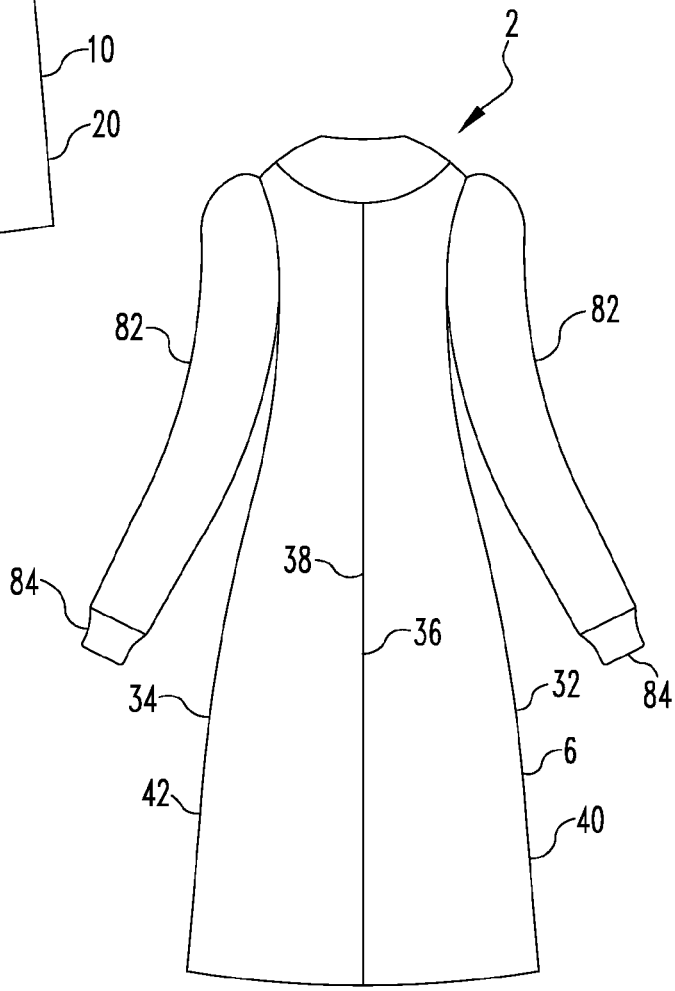
FIG. 2 is a back elevational view of the incontinence dress of FIG. 1.

Referring to FIGS. 1 and 2, the incontinence dress 2 is comprised of a front panel 4 and a back panel 6. As will be discussed in greater detail below, the front panel 4 as well as the back panel 6 is made from a three ply material, such as a three ply quilted material, which is water absorbent. Continuing with FIG. 1, the front panel 4 has a first panel 8 that is removably connected to a second panel 10, thereby allowing access to the interior 12 of the incontinence dress 2. Each of the first and second panels 8,10 has a first edge 14, 16 and a second edge 18,20. Disposed on the first edge 14,16 of the first and second panels 8,10 are means 22 for removably connecting the first panel 8 to the second panel 10. The means 22 can include, but shall not be limited to, a zipper, buttons, or Velcro. In one embodiment of the invention, the means 22 extends substantially along the entire length of the first edge 14, 16 of the first and second panels 8,10. Alternatively, the means 22 can also extend along a portion of the first edge 14,16 of the first and second panels 8,10.

In the embodiment that is depicted in FIG. 1, the first and second panels 8,10 have a pocket 24,25 that is disposed on a surface of the first panel 8. Typically, the pocket 24 that is disposed on the first panel 8 is adapted to receive a catheter or Foley bag 26 which is connected to the individual that is wearing the incontinence dress 2 by means 28, such as a tube, that are well known in the in the art. Positioned substantially adjacent to the pocket 24, and disposed on the surface of the first panel 8, is an aperture 30 through which the means 28 for connecting the catheter or Foley bag to the individual wearing the incontinence dress 2 is extended. It should be noted, however, that despite FIG. 1 depicting the pockets 24,25 as being disposed on each of the first and second panels 8,10, in other embodiments the incontinence dress 2 has one pocket that is disposed on either the first or second panel 8,10.

Referring to FIG. 2, the back panel 6 is comprised of a third panel 32 and a fourth panel 34. Each of the third and fourth panels 32,34 has a first edge 36,38 and a second edge 40,42. The first edge 36 of the third panel 32 is connected to the first edge 40 of the fourth panel 34 while the second edge 40,42 of the third and fourth panels 32,34 are connected to the second edge 18,20 of the first and second panels 8,10, respectively, using means that are commonly known in the art.

Figure 3:
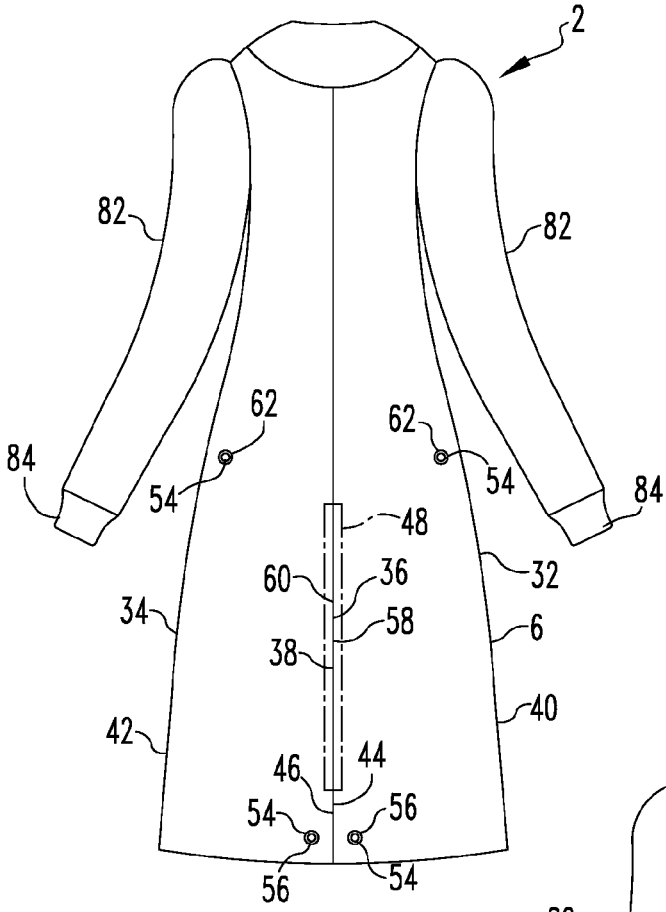
FIG. 3 is a back elevational view of the incontinence dress in accordance with another embodiment of the invention.
Figure 4:
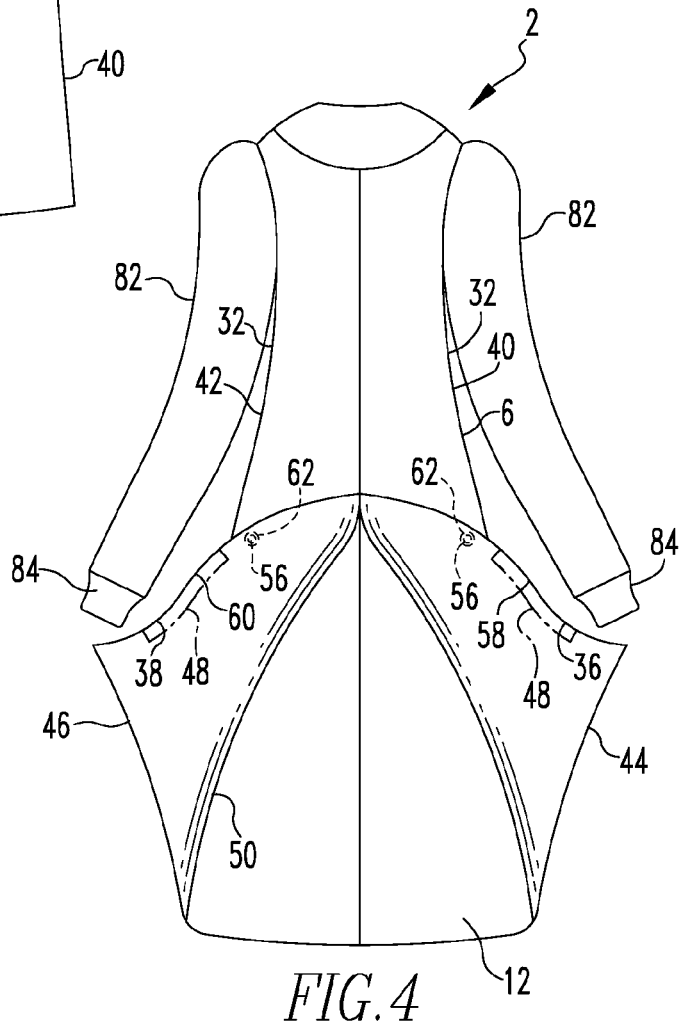
FIG. 4 is a back elevational view of the incontinence dress of FIG. 3 with a first portion of a mechanical fastener engage with a second portion of the mechanical fastener.
Figure 5:
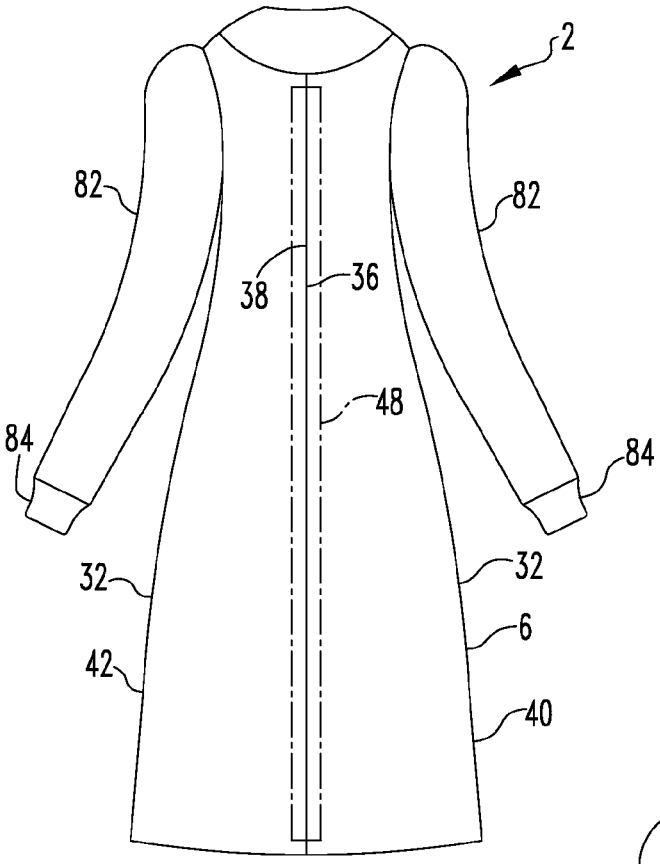
FIG. 5 is a back elevational view of the incontinence dress in accordance with another embodiment of the invention.
Figure 6:
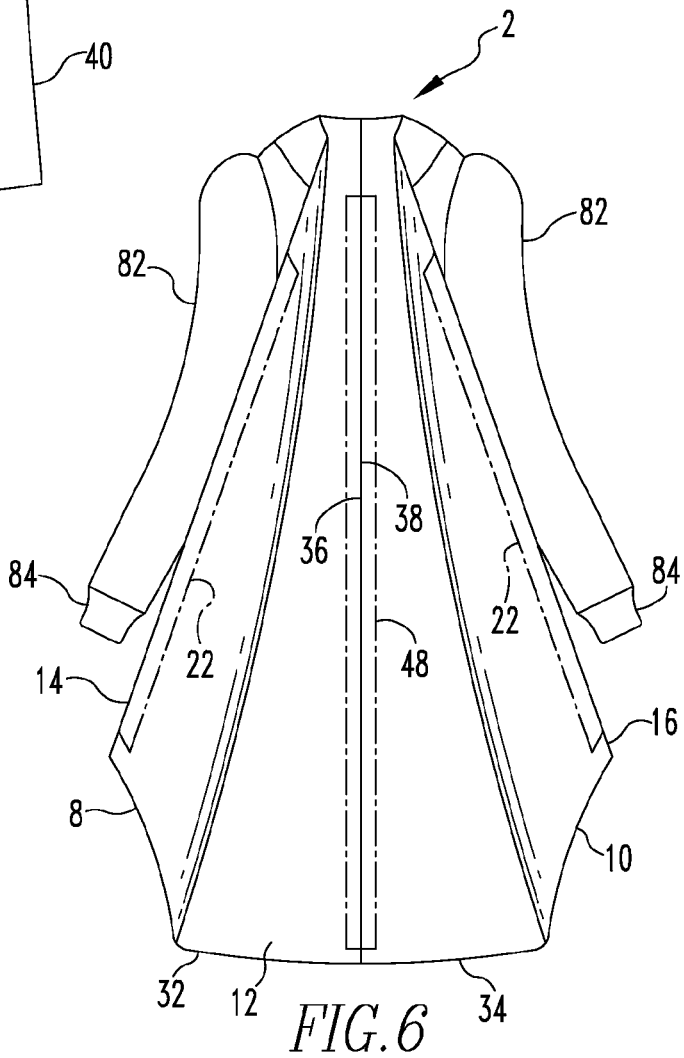
FIG. 6 is a front elevational view of the incontinence dress of FIG. 5.
Figure 7:
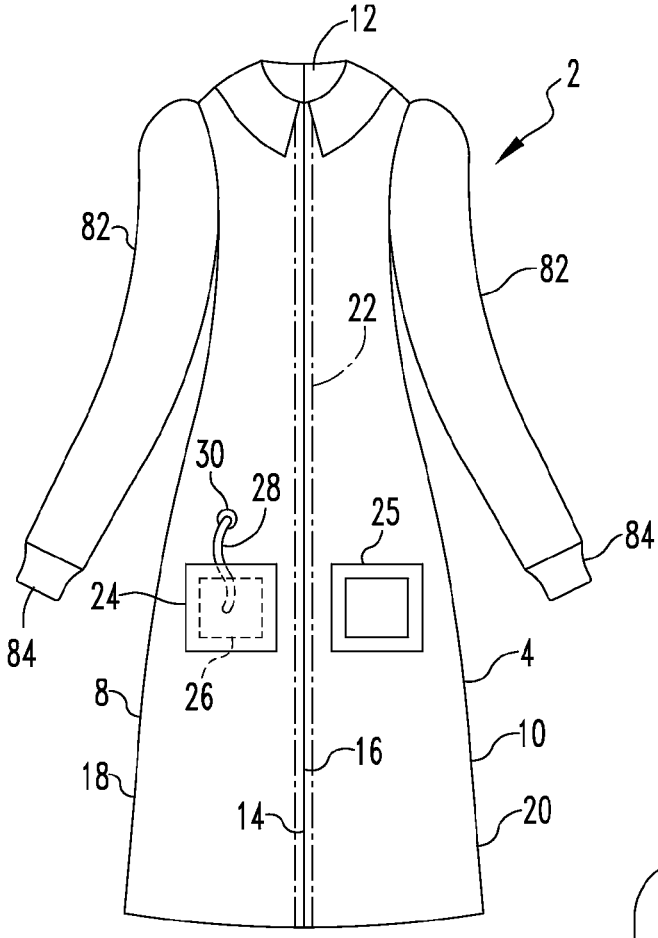
FIG. 7 is a front elevational view of the incontinence dress in accordance with an embodiment of the invention.
Figure 8:
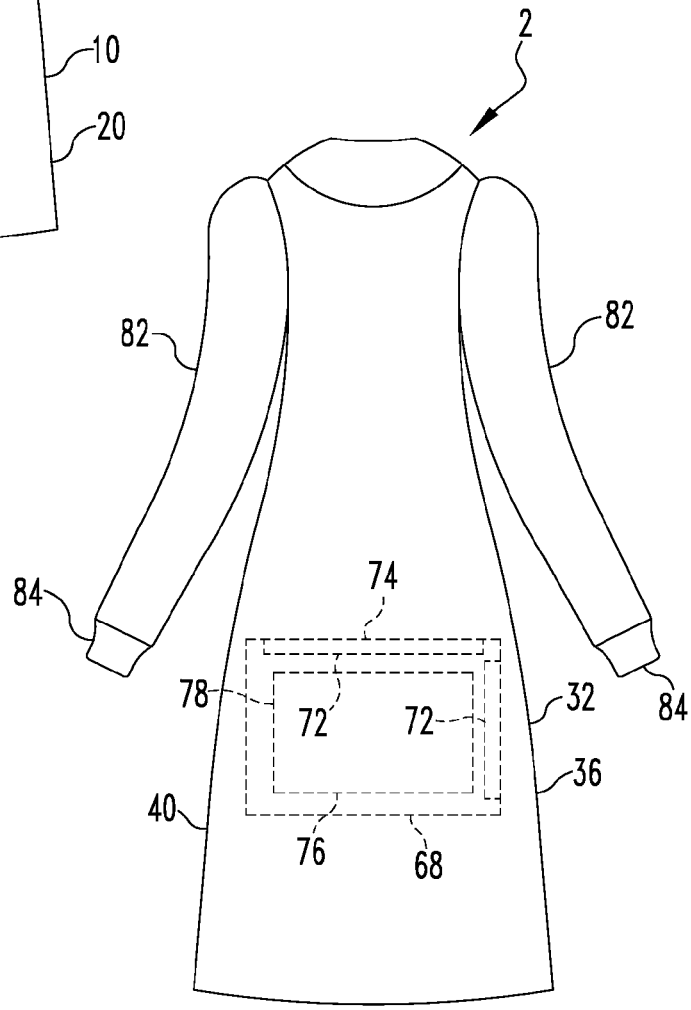
FIG. 8 is a back elevational view of the incontinence dress of FIG. 7.

Referring to FIGS. 3 and 4, in one embodiment of the invention, each of the third and fourth 32,34 panels has means 48, such as Velcro, a zipper, or buttons, which is disposed on the first edge 36,38 of the third and fourth panels 32,34 for removably connecting a portion 44 of the third panel 32 to a portion 46 of the fourth panel 34. For example, two inch (in.) Velcro squares can be disposed intermittently along the first edge 36 of the third panel 32 while corresponding pieces of fabric, which the Velcro squares can mechanically engage, are disposed along the first edge of the fourth panel 38. As can be seen from these figures, the means 48 for removably connecting the third panel 32 to the fourth panel 34 does not extend along the entire length of the first edge 36,38 of the third and fourth panels 32,34. Moreover, unlike the embodiment that is depicted in FIG. 2, when the separable portions 44,46 of the third and fourth panels 32,34 are separated (detached), an opening 50 is created between the first edges 58,60 of the separable portions 44,46. The opening 50 allows for access to the interior 12 of the incontinence dress 2. Continuing with FIGS. 3 and 4, a mechanical fastener 54, such as a snap, can be used to ensure that the separable portions 44,46 of the third and fourth panels 32,34 remain separated. For example, a first portion 56 of the mechanical fastener 54 can be disposed on or adjacent the first edge 58,60 of each the separable portions 44,46 of the third and fourth panels 32,24, while a second portion 62 of the mechanical fastener 54 is disposed on the second edge 40,42 of the third and fourth panels 32,34. When the first portion 56 of the mechanical fastener 54 is engaged with the second portion 62 of the mechanical fastener 54, the separable portions 44,46 of the third and fourth panels 32,34 will remain separated until the first and second portions 56,62 of the mechanical fastener 54 are disengaged from one another (FIG. 4). It should be noted, however, that despite FIGS. 3 and 4 depicting the means 48 for detachably connecting the third and fourth panels 32,34 as extending only along the separable portions 44,46 of the third and fourth panels 32,34, the means 48 can also extend along the entire length of the first edge 36,38 of the third and fourth panels 32,34 (FIGS. 5 and 6).

Referring to FIGS. 7-9A, similar to the other embodiments that are described above, the incontinence dress 2 in this particular embodiment is comprised of a front panel 4 and a back panel 6 that, as will be discussed in greater detail below, are made from a three ply water absorbent material. The front panel 4 has a first panel 8 that is removably connected to a second panel 10 thereby allowing access to the interior 12 of the incontinence dress 2. However, unlike the other embodiments that are described above, the back panel 6 only has one panel, a third panel 32. Disposed on the first edge 14,16 of each of the first and second panels 8,10 are means 22 for removably connecting the first panel 8 to the second panel 10. The means 22 can include, but shall not be limited to, a zipper or Velcro. As with the other embodiments described above, the means 22 can extend substantially along the entire length of the first edge 14,16 of the first and second panels 8,10 or the means 22 can extend along a portion of the first edge 14,16 of the first and second panels 8,10. Continuing with FIG. 7, the first and second panels 8,10 each have a pocket 24,25 that is disposed on a surface of the first and second panels 8,10. Typically, the pocket 24 that is disposed on the first panel 8 is adapted to receive a catheter or Foley bag 26 that is connected to the individual that is wearing the incontinence dress 2 by means 28, such as a tube, that are well known in the in the art. Positioned substantially adjacent to the pocket 24, and disposed on the surface of the first panel 8, is an aperture 30 through which the means 28 for connecting the catheter or Foley bag to the individual is extended. It should be noted, however, that despite FIG. 6 depicting the pockets 24,25 as being disposed on the first and second panels 8,10, in other embodiments the incontinence dress 2 has one pocket that is disposed on either the first or second panel 8,10.

Figure 9:
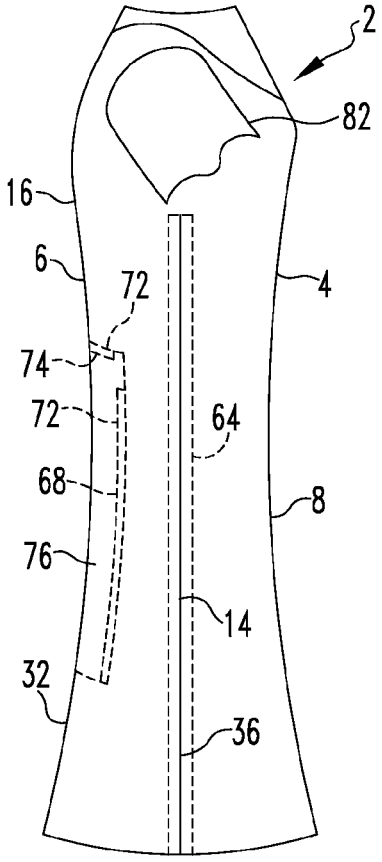
FIG. 9 is a side elevational view of the incontinence dress of FIG. 7.
Figure 9A:
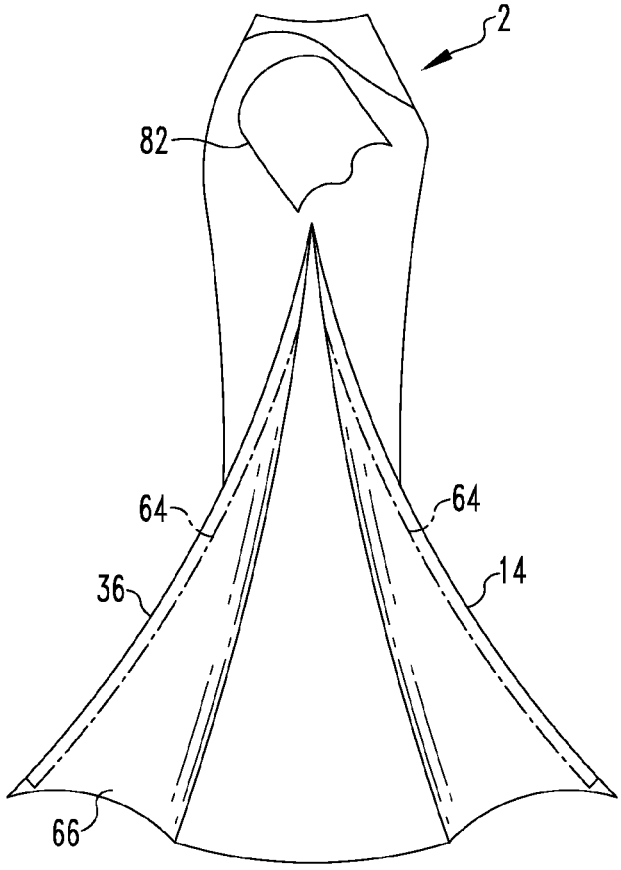
FIG. 9A is another side elevational view of the incontinence dress of FIG. 7.

As stated above, the back panel 6 is comprised of a third panel 32. Continuing with FIGS. 7 and 8, the third panel 32 has a first edge 36 and a second edge 40. The first edge 36 of the third panel 32 is removably connected to the first edge 14 of the first panel 8 by means 64 that are disposed on the first edge 14,36 of each of the first and third panels 8,32 (FIG. 9). Accordingly, the interior 12 of the incontinence dress 2 can be accessed not only by separating the first panel 8 from the second panel 10, but by separating the first panel 8 from the third panel 32 as well. The second edge 40 of the third panel 32 is connected to the second edge 20 of the second panel 10 by means that are commonly known in the art.

Disposed on an interior surface 66 of the third panel 32 is a pocket (second pocket) 68. The pocket 68 is detachably connected to the interior surface 66 of the third panel 32 by means 72 including, but not limited to, Velcro or a zipper. Additionally, the pocket 68 has a number of apertures 70 disposed on its surface (not shown). In the embodiment that is depicted in FIGS. 5 and 6, the pocket 68 has a substantially rectangular shape and at least one side 74 of the pocket 68 has means 72 for detaching the side 74 from the interior surface 66 of the third panel 32, thereby allowing access to the interior 76 of the pocket 68. Contained within the pocket 68 is a water absorbent pad 78 that can be replaced by detaching the side 74 of the pocket 68 on which the means 72 is disposed. Accordingly, urine that is excreted from an individual with a urinary incontinence disorder, and who is wearing the incontinence dress 2, can flow through the apertures disposed on the surface of the pocket 68 and be absorbed by the water absorbent pad 78 that is contained within the pocket.

Figure 10:
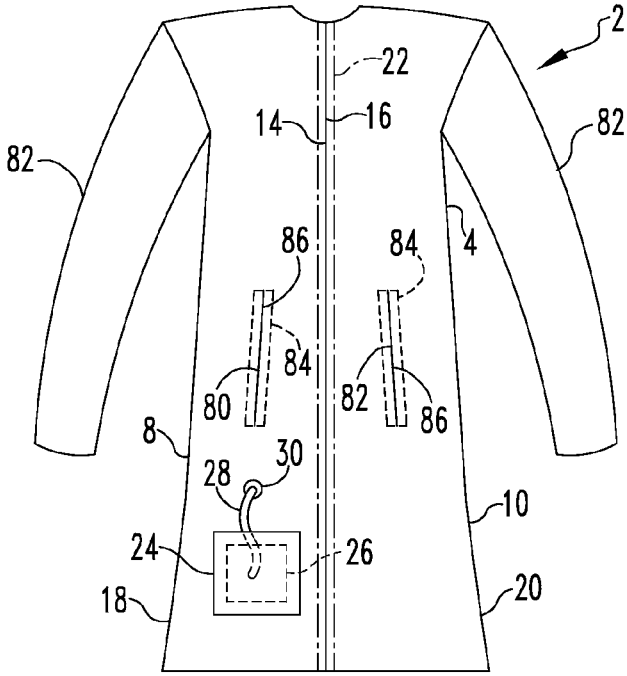
FIG. 10 is a front elevational view of another embodiment of the incontinence dress.
Figure 11:
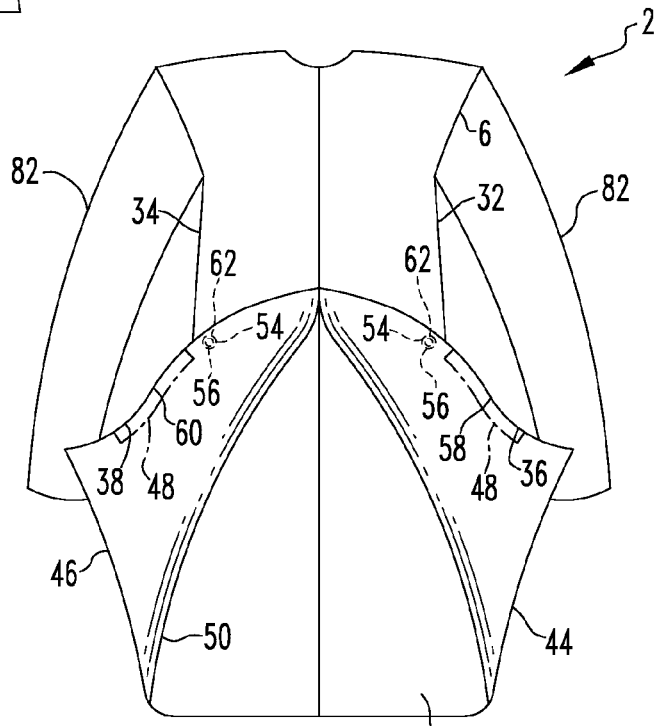
FIG. 11 is a back elevational view of the incontinence dress of FIG. 10.

Referring to FIGS. 10 and 11, similar to other embodiments of the incontinence dress 2 described above, this embodiment of the incontinence dress 2 is comprised of a front panel 4 and a back panel 6. The front panel has a first panel 8 and a second panel 10 while the back panel has a third panel 32 and a fourth panel 34. As will be discussed in greater detail below, the front panel 4 as well as the back panel 6 is made from a three ply material, such as a three ply quilted material, which is water absorbent. As best shown in FIG. 10, the front panel 4 has a first panel 8 that is removably connected to a second panel 10, thereby allowing access to the interior 12 of the incontinence dress 2. Each of the first and second panels 8,10 has a first edge 14, 16 and a second edge 18,20. Disposed on the first edge 14,16 of the first and second panels 8,10 are means 22 for removably connecting the first panel 8 to the second panel 10. The means 22 can include, but shall not be limited to, a zipper, buttons, or Velcro. In one embodiment of the invention, the means 22 extends substantially along the entire length of the first edge 14, 16 of the first and second panels 8,10. Alternatively, the means 22 can also extend along a portion of the first edge 14,16 of the first and second panels 8,10. Continuing with FIG. 10, the incontinence dress 2 further includes a pocket 24, which is disposed on the first panel 8 that is adapted to receive a catheter or Foley bag 26. Disposed substantially adjacent to the pocket 24 is an aperture 30 for receiving the means 28 that connect the catheter or Foley bag 26 to the individual wearing the incontinence dress 2.

However, unlike the other embodiments of the incontinence dress 2, the first and second panels 8,10 in this embodiment of the incontinence dress 2 each have an access slit 80,82 for accessing the interior 12 of the incontinence dress 2. Means 84, such as Velcro, a zipper, or buttons, for opening and closing the access slit 80,82 are disposed on or adjacent one or more sides 86 of the access slit 80,82.

Referring to FIG. 11, the back panel 6 of the incontinence dress 2 has a third panel 32 and a fourth panel 34. Each of the third and fourth 32,34 panels has means 48, such as Velcro, a zipper, or buttons, which is disposed on the first edge 36,38 of the third and fourth panels 32,34 for removably connecting a portion 44 of the third panel 32 to a portion 46 of the fourth panel 34. Similar to other embodiments of the incontinence dress 2, when the separable portions 44,46 of the third and fourth panels 32,34 are separated (detached), an opening 50 is created between the first edges 58,60 of the separable portions 44,46. The opening 50 allows for access to the interior 12 of the incontinence dress 2. A mechanical fastener 54, such as a snap, can be used to ensure that the separable portions 44,46 of the third and fourth panels 32,34 remain separated. For example, a first portion 56 of the mechanical fastener 54 can be disposed on or adjacent the first edge 58,60 of each the separable portions 44,46 of the third and fourth panels 32,24, while a second portion 62 of the mechanical fastener 54 is disposed on the second edge 40,42 of the third and fourth panels 32,34. When the first portion 56 of the mechanical fastener 54 is engaged with the second portion 62 of the mechanical fastener 54, the separable portions 44,46 of the third and fourth panels 32,34 will remain separated until the first and second portions 56,62 of the mechanical fastener 54 are disengaged from one another.

Referring to FIGS. 1-11, the embodiments of the incontinence dress 2 that are depicted in these figures all have long sleeves 82. Preferably, these long sleeves 82 are made from cotton or a double knit material. If a double knit material is used, then it is preferred that the double knit material is a cotton/polyester double knit material. However, other embodiments of the incontinence dress 2 can either have short sleeves (not shown) or no sleeves (not shown). FIGS. 1-11 also depict the incontinence dress as having elastic cuffs 84 located at an end of the long sleeve 82. It is noted, however, that an incontinence dress that lacks the elastic cuffs 84 (FIG. 10) also falls within the scope of this invention.

Figure 12:
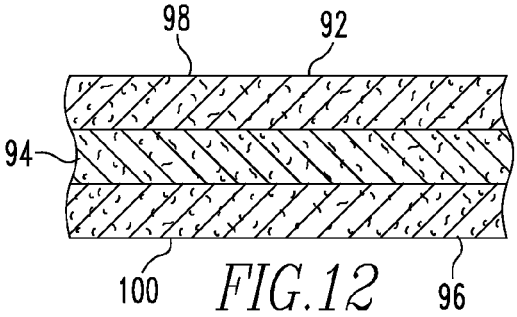
FIG. 12 is a cross sectional view of the water absorbent three ply material from which the incontinence dress may be made.

As stated above, the front 4 and back panels 6 of the incontinence dress 2 is made from a water absorbent three ply material. Referring to FIG. 12, the three ply material has a first layer 92, a second layer 94, and a third layer 96. The first and third layers 92,96 can be made from cotton while the second layer 94 can be made from a polyester fabric. Moreover, the first and third layers 92,96 may be finished and/or have a pattern printed on the surface 98,100 of the layer 92,96 as is commonly known in the art.

While specific embodiments of the invention have been described in detail above, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed and claimed concept which is to be given the full breadth of the claims appended and any and all equivalents thereof.

What is claimed is:

1. An incontinence dress comprising:

a first panel having a first edge and a second edge;

a second panel having a first edge and a second edge;

a third panel having a first edge and a second edge, said first edge of said first panel being connected to said first edge of said second panel, said second edge of said first panel being connected to said first edge of said third panel, said second edge of said second panel being connected to said second edge of said third panel, said first panel and said second panel forming a front panel of said dress and said third panel forming a back panel of said dress;

a first fastening mechanism disposed at least partially along the first edge of the first panel and the first edge of the second panel, said first fastening mechanism for detachably connecting said first panel to said second panel;

a second fastening mechanism for detachably connecting at least one of said second edge of said first panel to said first edge of said third panel and said second edge of said second panel to said second edge of said third panel, wherein said second fastening mechanism extending substantially along the entire length of at least one of said second edge of said first panel and said first edge of said third panel, and said second edge of said second panel and said second edge of said third panel;

a pocket disposed on an interior surface of said third panel and a third fastening mechanism for detachably connecting said pocket to said interior surface, an absorbent pad contained within said pocket, wherein each of said first, second and third panels is made from a three ply absorbent material comprising a first layer, a second layer and a third layer.

2. The incontinence dress according to claim 1, wherein said first and third layers are made from a cotton fabric and said second layer is made from a polyester fabric.

3. The incontinence dress according to claim 1, wherein said first or said second panels has an aperture disposed on a surface, said aperture being positioned substantially adjacent to a second pocket that is connected to said surface of said first or second panels.

4. The incontinence dress according to claim 3, wherein a catheter bag is positioned within said second pocket, said catheter bag having means for connecting said catheter bag to an individual wearing said incontinence dress, said means extending through said aperture.

5. The incontinence dress according to claim 1, further comprising a first sleeve and a second sleeve, said first sleeve is connected to said first and third panels and said second sleeve is connected to said second and third panels.

6. The incontinence dress according to claim 5, wherein each of said first and second sleeves is made from a double knit material.

7. The incontinence dress according to claim 1, wherein said pocket has a plurality of apertures disposed on said surface.

8. An incontinence dress comprising:

a first panel;

a second panel;

a third panel;

a fourth panel;

a first sleeve panel;

a second sleeve panel;

said first panel being connected to said third panel, said third panel being connected to said fourth panel, said fourth panel being connected to said second panel, wherein said first panel and said second panel form a front panel of said dress and said third panel and said fourth panel form a back panel of said dress, and wherein said front panel and said back panel form a body of said dress;

said first sleeve panel being connected to said first and said third panels and said second sleeve panel being connected to said second and said fourth panels, wherein said first sleeve and said second sleeve are both made of a material, said material being different from a material which makes up said body of said dress; and a fastening mechanism disposed at least partially along a first edge of said third panel and a first edge of said fourth panel, said fastening mechanism for detachably connecting said third panel to said fourth panel;

a first mechanical fastener having a first portion and a second portion, said first portion disposed adjacent said first edge of said third panel and said second portion disposed on a second edge of said third panel, wherein said first and said second portions are engaged;

a second mechanical fastener having a first portion and a second portion, said first portion disposed adjacent said first edge of said fourth panel and said second portion disposed on a second edge of said fourth panel, wherein said first and said second portions are engaged;

wherein said third and said fourth panels being detached and said first and said second portions of said first and said second mechanical fasteners being engaged form an opening between said first edges of said third and said fourth panels, and wherein each of said first, second, and third and fourth panels is made from a three ply material that is absorbent, said material comprising a first layer, a second layer and a third layer.

9. The incontinence dress according to claim 8, wherein said first and third layers are made from cotton and said second layer is made from a polyester fabric.

10. The incontinence dress according to claim 8, wherein said first or said second panels has an aperture disposed on a surface, said aperture being positioned substantially adjacent to a pocket that is connected to said surface of said first or second panels.

11. The incontinence dress according to claim 10, wherein a catheter bag is positioned within said pocket, said catheter bag having means for connecting said catheter bag to an individual wearing said incontinence dress, said means extending through said aperture.

12. The incontinence dress according to claim 8, further comprising a first sleeve and a second sleeve, said first sleeve is connected to said first and third panels and said second sleeve is connected to said second and fourth panels.

13. The incontinence dress according to claim 12, wherein each of said first and second sleeve panels is made from a double knit material.

14. The incontinence dress according to claim 8, wherein said incontinence dress has a fastening mechanism for detachably connecting a portion of said third panel to a portion of said fourth panel.

15. The incontinence dress according to claim 14, wherein said fastening mechanism extending substantially along the entire length of said third and fourth panels.

* * * * *